US008827497B1

(12) United States Patent
Newman et al.

(10) Patent No.: US 8,827,497 B1
(45) Date of Patent: Sep. 9, 2014

(54) TILT AND CLEAN SLIDING LIGHT ASSEMBLY BRACKET AND LIGHT FIXTURE

(71) Applicant: Palm Coast Imports, LLC, Germantown, TN (US)

(72) Inventors: Jeff Newman, Germantown, TN (US); Bruce Nemac, Madison, WI (US); Jason Rohr, Palmyra, WI (US)

(73) Assignee: Palm Coast Imports, LLC, Germantown, TN (US)

( * ) Notice: Subject to any disclaimer, the term of this patent is extended or adjusted under 35 U.S.C. 154(b) by 0 days.

(21) Appl. No.: 13/739,761

(22) Filed: Jan. 11, 2013

(51) Int. Cl.
*F21V 21/04* (2006.01)
*F21V 21/02* (2006.01)
*F21V 21/03* (2006.01)

(52) U.S. Cl.
CPC ..... *F21V 21/03* (2013.01)
USPC ..... 362/277; 362/430; 362/365

(58) Field of Classification Search
CPC ..... F21S 2/005; F21S 8/02; F21V 17/107; F21V 21/04; G03B 21/16
See application file for complete search history.

(56) References Cited

U.S. PATENT DOCUMENTS

| | | | | |
|---|---|---|---|---|
| 4,001,574 | A | 1/1977 | Porter | |
| 4,342,073 | A | 7/1982 | Ranten | |
| D404,167 | S | 1/1999 | Dolan | |
| 6,309,083 | B1 * | 10/2001 | Lathrop et al. | 362/96 |
| 6,494,589 | B1 | 12/2002 | Shyu | |
| 7,150,544 | B2 | 12/2006 | Pearce | |
| D546,302 | S | 7/2007 | Kita | |
| 2004/0151588 | A1 * | 8/2004 | Liang | 416/142 |
| 2009/0072108 | A1 * | 3/2009 | Oleson | 248/282.1 |
| 2010/0135030 | A1 * | 6/2010 | Ishibashi | 362/365 |
| 2010/0165646 | A1 * | 7/2010 | Russo et al. | 362/430 |
| 2013/0149147 | A1 * | 6/2013 | Villella | 416/5 |

* cited by examiner

*Primary Examiner* — Tracie Y Green
(74) *Attorney, Agent, or Firm* — Brian S. Steinberger; Law Offices of Brian S. Steinberger, P.A.

(57) ABSTRACT

Devices, apparatus, fixtures, systems and methods of using a sliding hanger bracket for overhead lights that allows the light shade, such as a glass bowl, to lower away from a ceiling fan or light base, and tilt allowing the light shade to be cleaned and change light sources, such as the light bulbs, without having to disassemble the light fixture. The hanger bracket can have an up position locked in place where the outside of the overhead light appears undistinguishable from traditional ceiling light fixtures or lights on ceiling fans.

19 Claims, 18 Drawing Sheets

TILT AND CLEAN SLIDING LIGHT ASSEMBLY BRACKET AND LIGHT FIXTURE

FIELD OF INVENTION

This invention relates to light fixtures, and in particular to devices, apparatus, assemblies, fixtures, systems and methods of a sliding hanger bracket for a light shade, such as a glass bowl, to lower away from a ceiling fan or light base, and tilt allowing the light shade to be cleaned and to change light sources, such as the light bulbs, without having to disassemble the light fixture.

BACKGROUND AND PRIOR ART

Light fixtures with light shades, such as those having a glass type bowl have been used for ceiling mounted lights and for ceiling fans for many years. See for example, U.S. Pat. Des. No. 404,167 to Dolan; U.S. Pat. No. 4,342,073 to Ranten; and U.S. Pat. No. D543,302 to Ertze. These popular types of ceiling fan light kits and flush mounted or semi-flush mounted light fixtures require disassembly of the shade/bowl portion of the light in order to clean the inside of the shade/bowl and/or to change out the lights sources (bulbs) when needed. However, cleaning the inside of the shade/bowl and changing out the light source has many problems.

The light shade/bowl is usually fixed to the fixture by at least one or more rotatable fasteners, such as nuts. The difficulty of trying to disassemble the overhead shade/globe is difficult and can be time consuming. The light shade/bowl is also usually a fragile piece of the light fixture and is often made of glass or thin plastic. Dropping the light shade/bowl and breaking it can often occur when the shade/bowl is being disassembled. Also, the person can be can also be injured from the falling shade/bowl and/or by other injuries such as falling off a ladder, and the like.

Thus, the need exists for solutions to the above problems with the prior art.

SUMMARY OF THE INVENTION

A primary objective of the present invention is to provide devices, apparatus, fixtures, systems and methods of using a sliding hanger bracket that allows a light shade to lower away from a light fixture on a ceiling fan or ceiling base, and tilt the shade to be cleaned and to change out light sources (bulbs) without having to disassemble the light fixture.

A secondary objective of the present invention is to provide devices, apparatus, fixtures, systems and methods of providing light shades on ceiling fixtures and ceiling fans to be tilted for cleaning out the shades and for changing light sources, where the light fixtures appear undistinguishable from traditional ceiling light fixtures or lights on ceiling fans.

A unique benefit in the invention is that the sliding bracket can rigidly hold the lamp shape in place securely until service is needed for the light assembly—cleaning or changing bulbs. The novel sliding bracket can then be lowered to allow the user to service the light kit. The user merely needs to simply push up and move the shade to one side and the light kit assembly will lower to the cleaning position. In this position, it is possible to tilt the light fixture from side to side to allow greater access for servicing the bulbs and inside of the light shade.

The tilt and clean assembly can include a dual bracket assembly where one bracket is fixed, has downward parallel arms and is slotted and the other bracket slides from locked position to cleaning position by using pins that are secured through the slots in the fixed bracket. When in the locked position, the light assembly is undistinguishable from other light kits.

An overhead light fixture according to the invention can include an upper bracket having a top end and a bottom end, the top end being attached to a ceiling mounted member, a bottom bracket having a top end and a bottom end, the top end of the lower bracket being slidable from a retracted lock position located above the bottom end of the upper bracket to a lowered position, a pivotable portion for allowing the lower bracket to tilt relative to the upper bracket, when the bottom bracket is in the lowered position, a removable light source attached to one of the upper bracket and the bottom bracket, and a light shade attached to the bottom end of the bottom bracket, wherein the light shade is tiltable when the bottom bracket is in the lowered position so that the light source and inside of the light shade are serviceable.

The ceiling mounted member can include a ceiling mounted member for attaching the light fixture to a ceiling. The ceiling mounted member can include a an attachment member for attaching the light fixture to a ceiling fan. The light shade can have a bowl shape or another shape.

The upper bracket can include an elongated leg member having an elongated slot, and a sliding member attached to the top end of the lower bracket so that the bottom bracket can slide up and down by the sliding member sliding within the elongated slot. The sliding member can also the pivotable member. The sliding member can be a pin. Alternatively, the sliding member can be a screw.

The upper bracket can include a second elongated leg member having a second elongated slot, the second elongated member being parallel to the first elongated leg member, and a second sliding member attached to the top end of the lower bracket so that the bottom bracket can slide up and down by the second sliding member sliding within the second elongated slot.

The vertical slot can include a hook shaped slot at the top of the first elongated slot for locking the bottom bracket in the retracted lock position.

A method of servicing a light source and inside of a light shade on overhead light fixture without having to disassemble the light fixture, can include the steps of attaching a top bracket to a ceiling mount member, attaching a bottom bracket to a light shade, slidably attaching the top bracket and the bottom bracket to each other, sliding the bottom bracket from an up position to a down position, tilting the light shade and the bottom bracket when the bottom bracket is in the down position, and servicing the light source and inside of the light shade when the light shade is tilted without disassembling the overhead light fixture.

The method can include the step of providing a ceiling mounted light as the overhead light fixture. The method can include the step of attaching the ceiling mount member to a ceiling fan.

The method can include the steps of providing the top bracket with an elongated vertical leg member having a longitudinal slot, attaching a pin to the bottom bracket, and sliding the bottom bracket up and down to the top bracket by the pin sliding in the longitudinal slot.

The method can include the steps of providing the top bracket with a second elongated vertical leg member having a second longitudinal slot, the second elongated vertical leg member being parallel to the first elongated vertical member, attaching a second pin to the bottom bracket, and sliding the bottom bracket up and down to the top bracket by the second pin sliding in the second longitudinal slot.

The method can include the step of locking the bottom bracket in the up position. The locking step can include the steps of providing the first longitudinal slot with a hook slot at an upper end and positioning the first pin in the hook slot.

The method can include the step of pushing up on the bottom bracket to release the bottom bracket from the locked up position.

An overhead light fixture assembly for allowing light shades and lights sources to be serviceable without having to disassemble the fixture assembly, can include a top rigid member attached to a ceiling mount member, a bottom rigid member moveably attached to the top rigid member, a light shade attached to the bottom rigid member, and a removable light source attached to the fixture assembly between the ceiling mount member and the light shade, wherein the bottom rigid member with light shade is moveable from an upper position to a lower position, and the light shade is tiltable in the lower position to allow the light source and interior of the light shade to be serviced.

The assembly can include a lock position for locking the bottom rigid member to the top rigid member with the bottom rigid member is in the upper position.

Further objects and advantages of this invention will be apparent from the following detailed description of the presently preferred embodiments which are illustrated schematically in the accompanying drawings.

DESCRIPTION OF THE PREFERRED EMBODIMENTS

Figure 2:
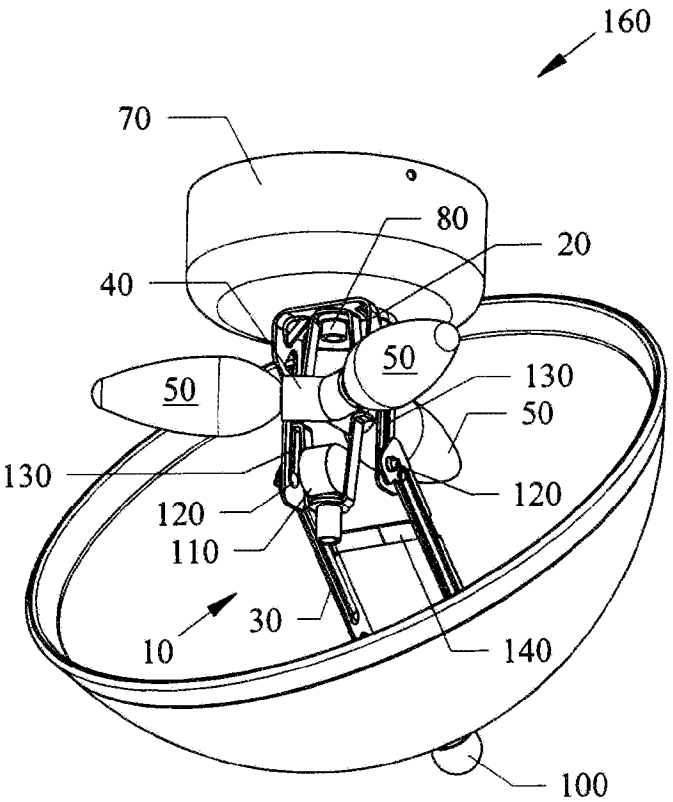
FIG. 2 is a perspective view of the light assembly of FIG. 1 with bottom bracket dropped and tilted back for bulb and cleaning access.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A description of components will now be described.

10 Tilt & Clean fixture assembly.
20 Top/upper bracket.
23. Through-hole
24. Horizontal member
26. vertical leg
28. vertical leg
30 Bottom/lower bracket.
32. vertical leg
34. vertical leg
36. horizontal member
37. through-hole
40 Light socket bracket.
42. Horizontal member
43. Through-hole
50 Light bulb.
60 Light shade.
70 Mount flange.
80 Mount flange to top bracket mounting shaft.
87. nut
90 Upper finial.
100 Lower finial.
110 Light switch.
120 Bottom bracket pivot screw(s) or pin(s)
130 Slot in upper bracket. Item
140 Bottom bracket lock bar.
150 Upper bracket lock hook.
160 Ceiling mount light assembly.
170 Fan mount light assembly.
180 Ceiling fan.
190 Shade mount flange.
200 Shade & finial mounting shaft.
210 Finial mounting nut.
220 Resting slot at the top of each top bracket slot.

Figure 1:
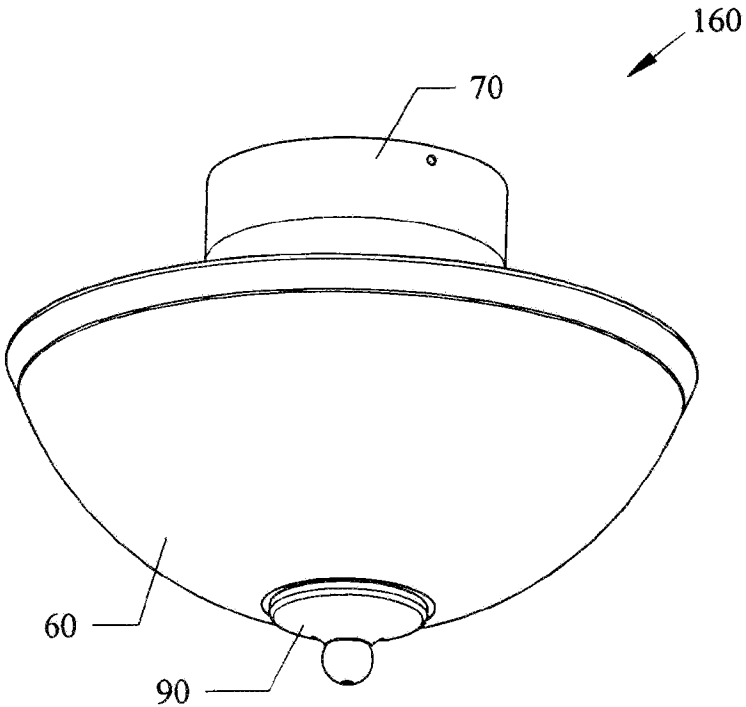
FIG. 1 is a perspective view of the exterior of the novel ceiling mount light assembly.

FIG. 1 is a perspective view of the exterior of the novel ceiling mount light assembly 160. FIG. 2 is a perspective view of the light assembly 160 of FIG. 1 with bottom bracket 30 dropped and tilted back for bulb 50 and cleaning access.

Referring to FIGS. 1-2, the ceiling mount light assembly 160 can include a mount flange 70 which can attached to a ceiling. Mount flange 70 can support a light shade/bowl 60 with a decorative upper portion (upper finial) 90 and decorative lower portion (lower finial) 100, with a tilt and clean fixture assembly 10 between the mount flange 70 and light shade/bowl 60.

Figure 3:
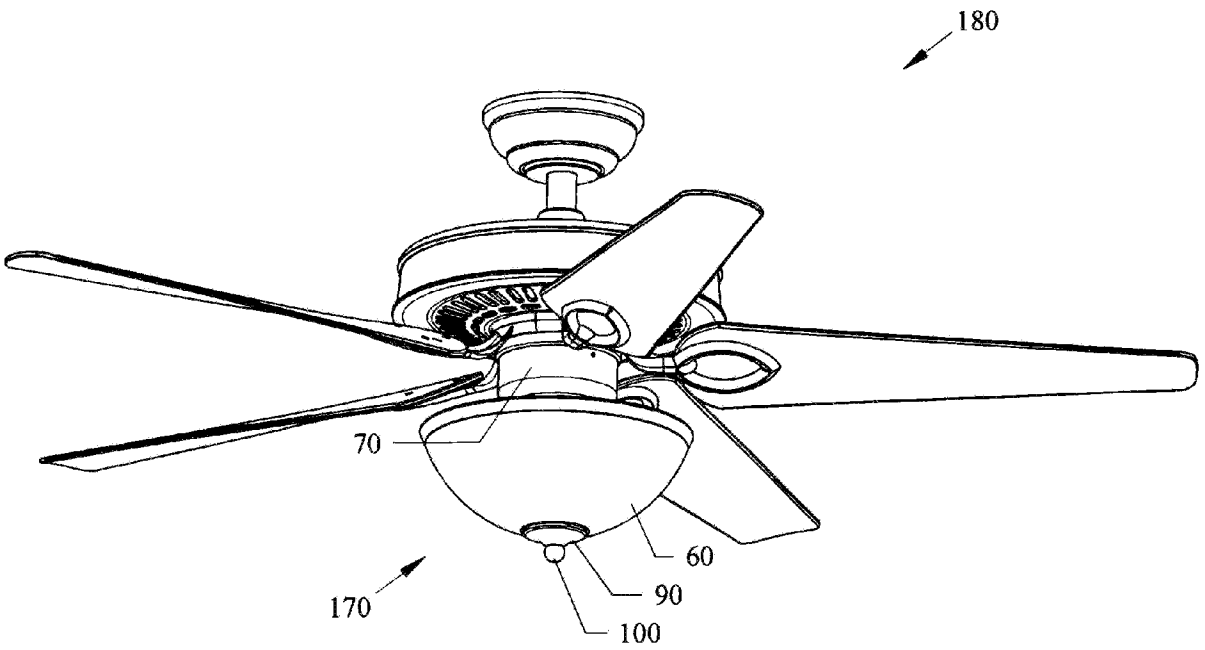
FIG. 3 is a perspective view of the exterior of the novel mount light assembly mounted to a ceiling fan.
Figure 4:
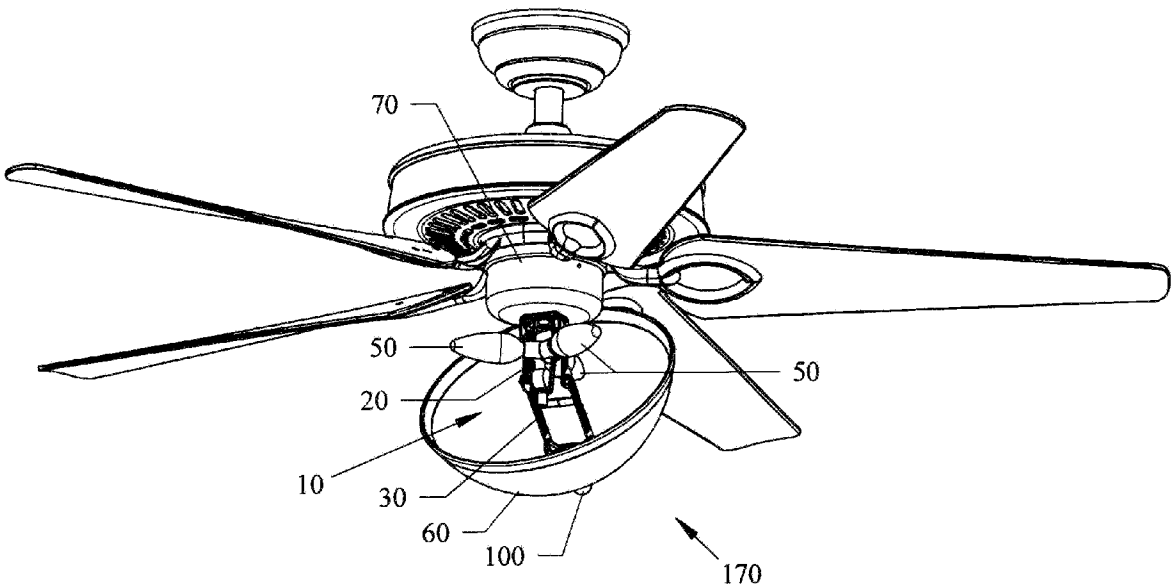
FIG. 4 is a perspective view of the light assembly of FIG. 3 with bottom bracket dropped and tilted back for bulb and cleaning access.

FIG. 3 is a perspective view of the exterior of the novel mount light assembly 170 mounted to a ceiling fan 180. FIG. 4 is a perspective view of the light assembly 170 of FIG. 3 with bottom bracket 30 dropped and tilted back for bulb 50 and cleaning access.

Referring to FIGS. 3-4, the ceiling fan mount assembly 170 can include a mount flange 70 which is attached to the motor portion of a ceiling fan 180. Similar to the previous embodiment, mount flange 70 can support a light shade/bowl 60 with a decorative upper portion (upper finial) 90 and decorative lower portion (lower finial) 100, with a tilt and clean fixture assembly 10 between the mount flange 70 and light shade/bowl 60.

Referring to FIGS. 2 and 4, the tilt and clean fixture assembly 10 can include a bottom bracket 30 is pivotally attached to a top bracket 20, which mounts a light socket bracket 40 thereon which holds the bulbs 50 in place. The top bracket 20 has two parallel legs each having elongated vertical slots 130 which allows for a bottom bracket pivot screw 120 to up and down in these slots 130 allowing for the bottom bracket 30 slide up and down. A bottom bracket bar 140 and light switch 110 will be described later.

Figure 5:
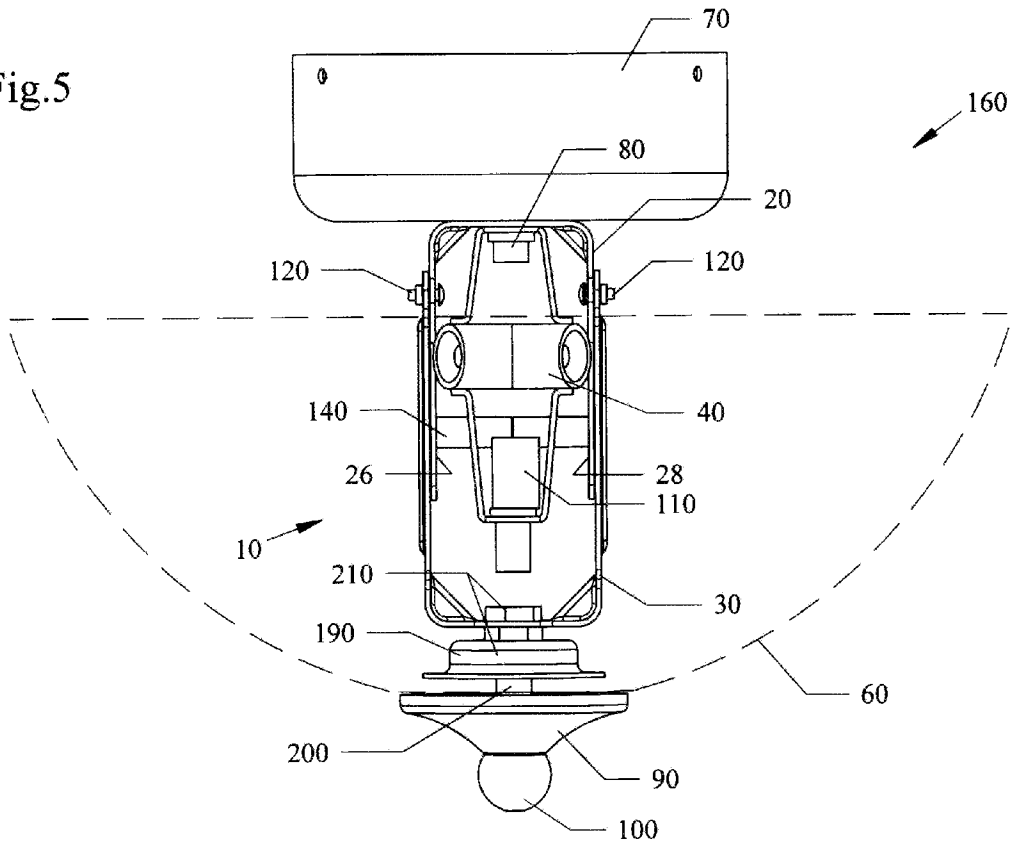
FIG. 5 is a front view of the light assembly of FIGS. 1-2 locked up without bulbs and with shade in dash line.

FIG. 5 is a front view of the light assembly 160 of FIGS. 1-2 locked up without bulbs 50 and with shade 60 in dashed lines.

Figure 6:
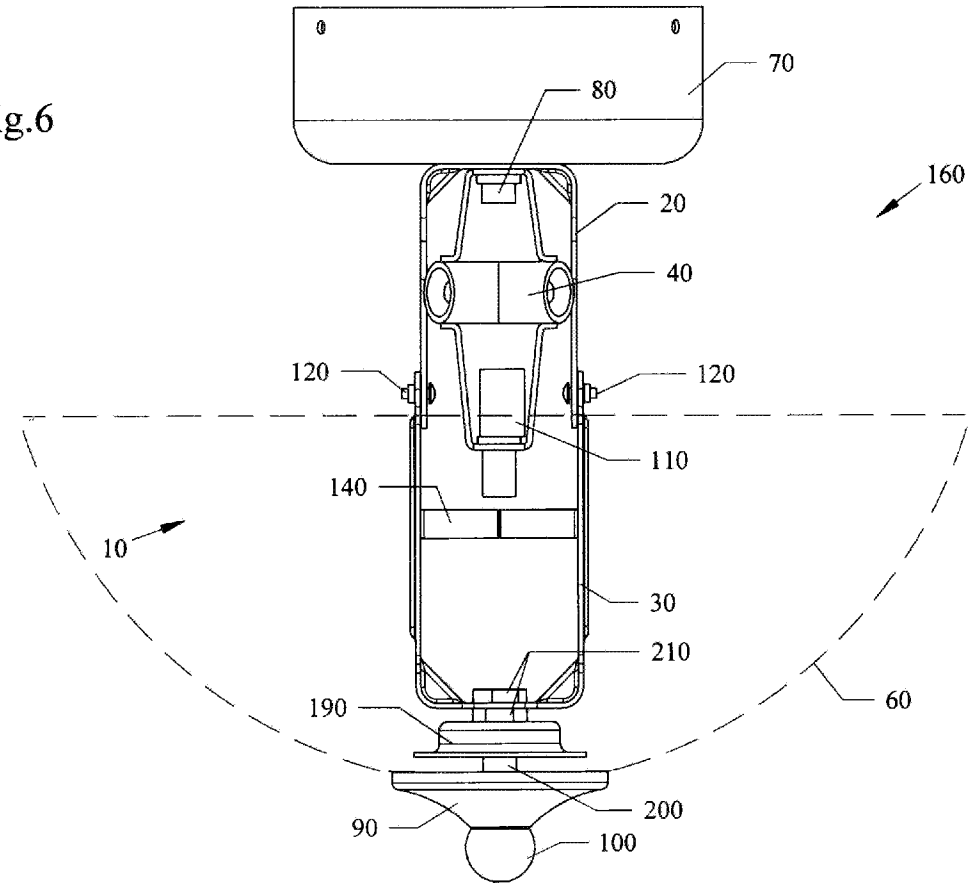
FIG. 6 is a front view of the light assembly of FIG. 5 with bottom bracket dropped.

FIG. 6 is a front view of the light assembly 160 of FIG. 5 with bottom bracket 30 dropped.

Figure 7:
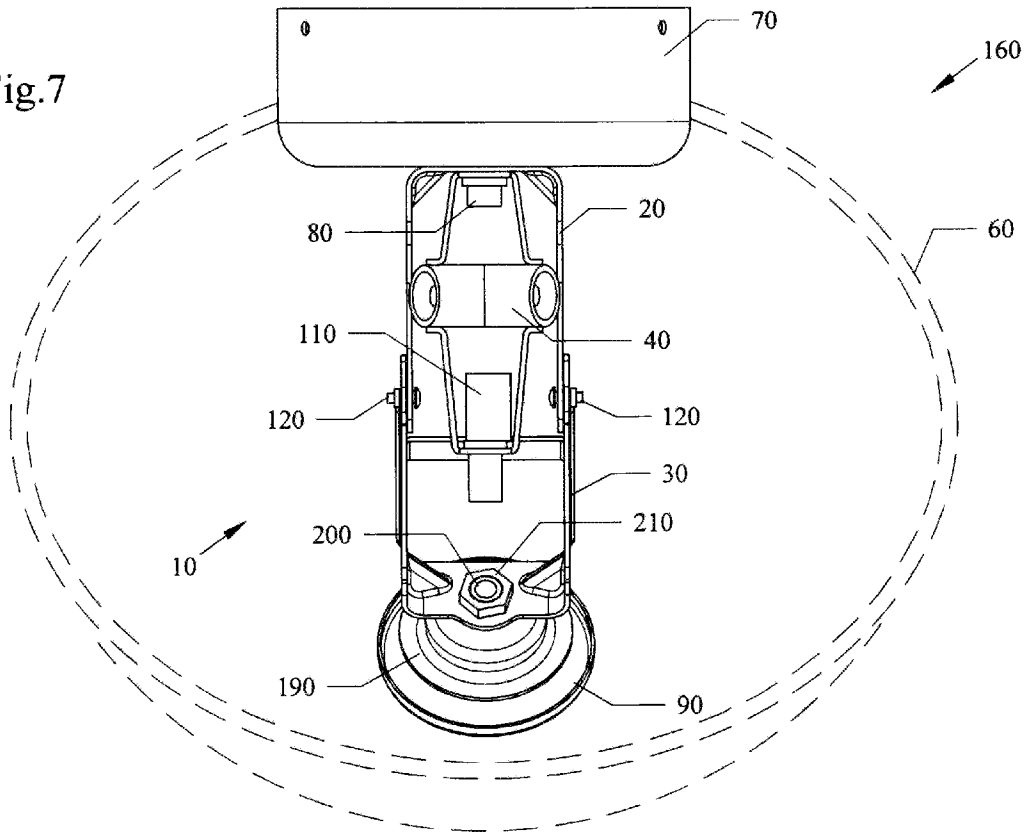
FIG. 7 is a front view of the light assembly of FIG. 6 with bottom bracket tilted away from viewer.

FIG. 7 is a front view of the light assembly 160 of FIG. 6 with bottom bracket 30 tilted away from viewer.

Figure 8:
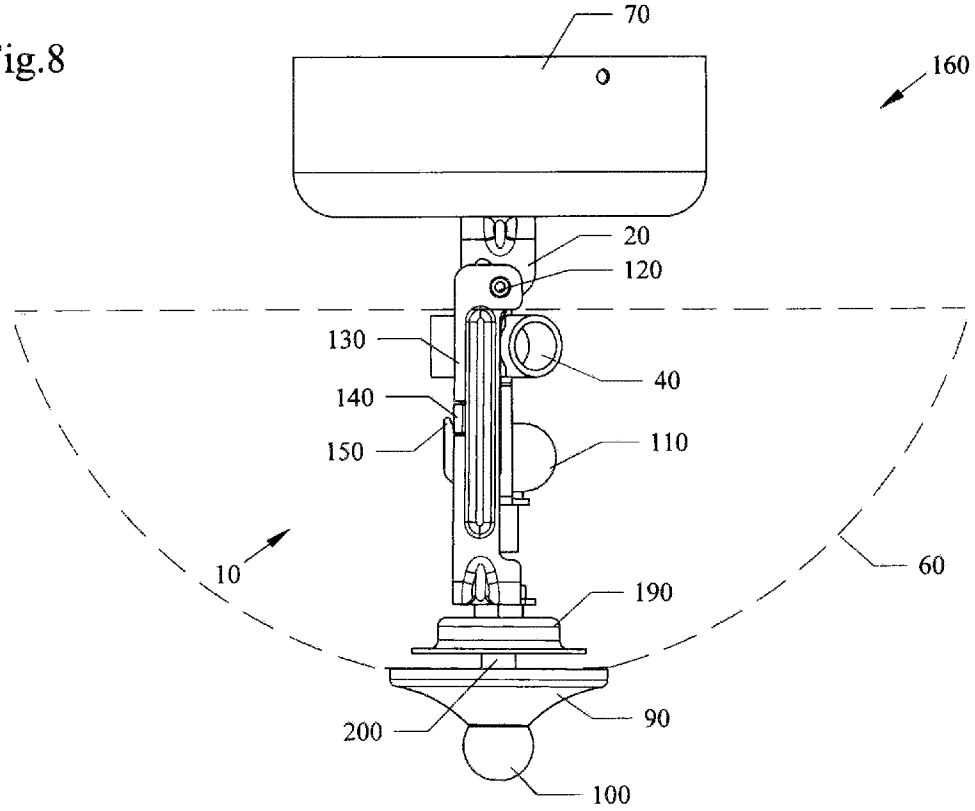
FIG. 8 is a side view of light assembly of FIG. 5 with brackets locked up without bulbs and with shade in dash line.

FIG. 8 is a side view of light assembly 160 of FIG. 5 with brackets 20, 30 locked up without bulbs 50 and with shade 60 in dashed lines.

Figure 9:
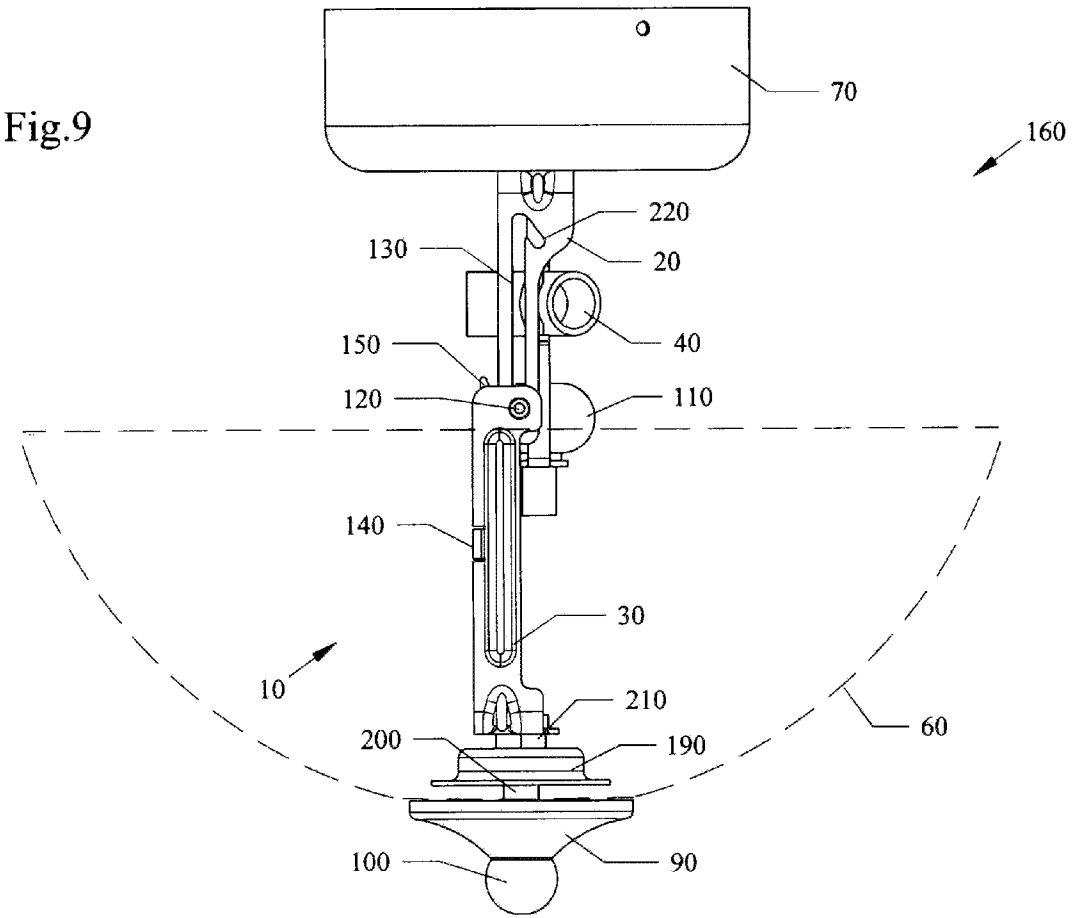
FIG. 9 is a side view of the light assembly of FIG. 6 with bottom bracket dropped.

FIG. 9 is a side view of the light assembly 160 of FIG. 6 with bottom bracket 30 dropped.

Figure 10:
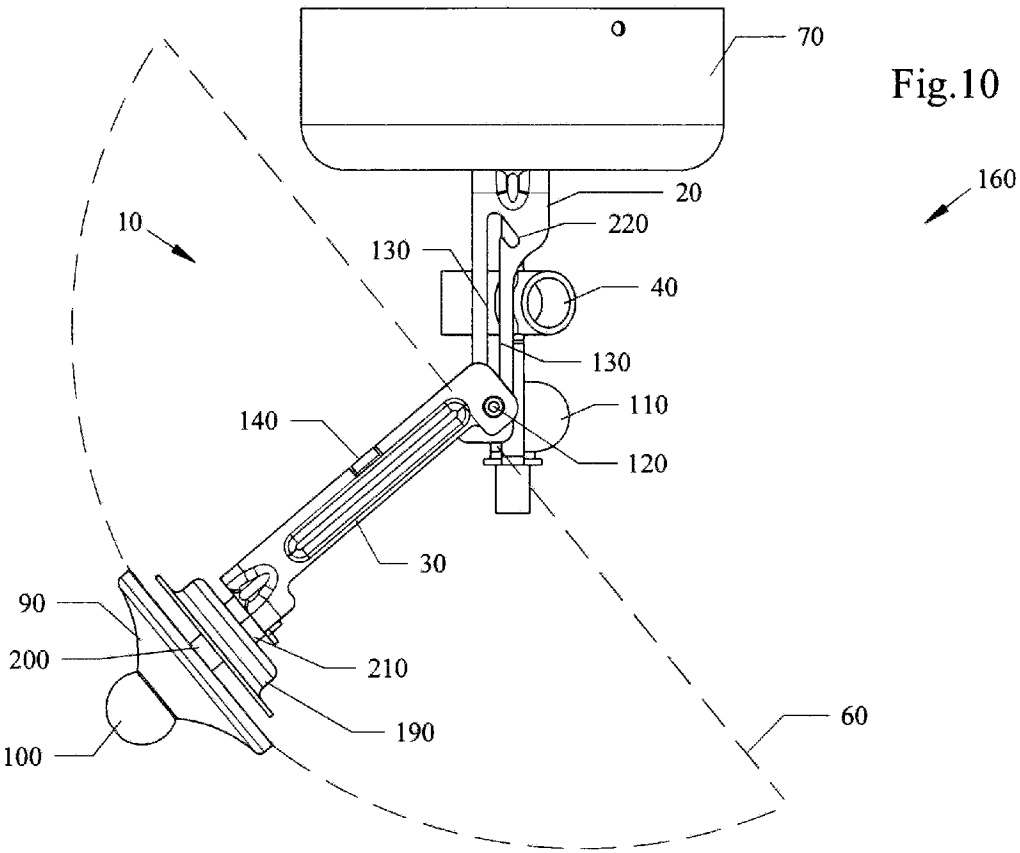
FIG. 10 is a side view of the light assembly of FIG. 7 with bottom bracket tilted to the left.

FIG. 10 is a side view of the light assembly 160 of FIG. 7 with bottom bracket 30 tilted to the left.

Figure 11:
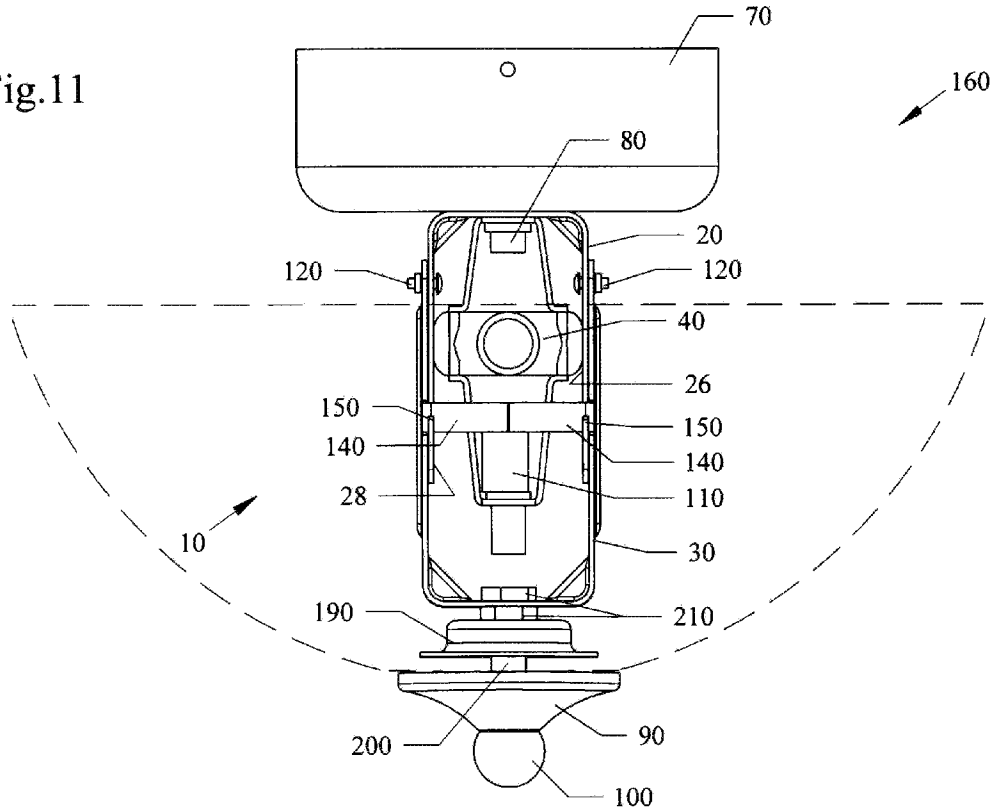
FIG. 11 is a back view of the light assembly of FIG. 8 with brackets locked up without bulbs and with shade in dash line.

FIG. 11 is a back view of the light assembly 160 of FIG. 8 with brackets 20, locked up without bulbs 50 and with shade 60 in dashed lines.

Figure 12:
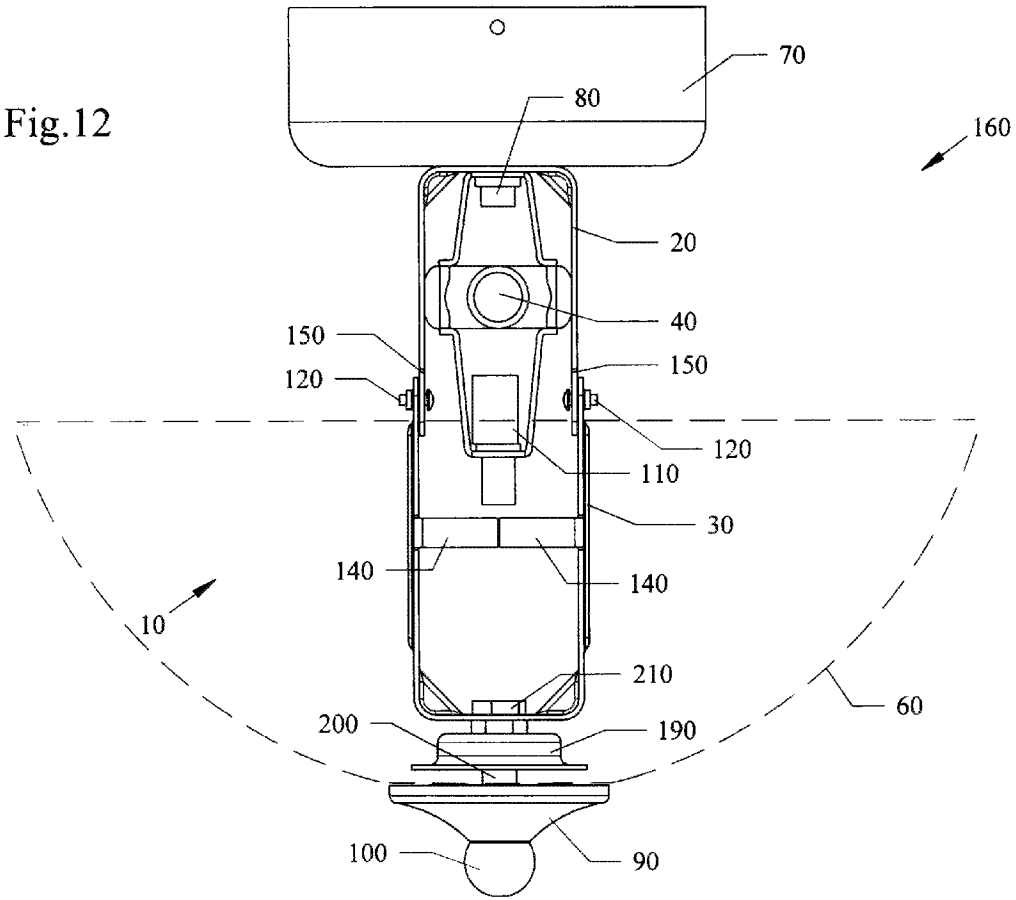
FIG. 12 is a back view of the light assembly of FIG. 9 with bottom bracket dropped.

FIG. 12 is a back view of the light assembly 160 of FIG. 9 with bottom bracket 30 dropped.

Figure 13:
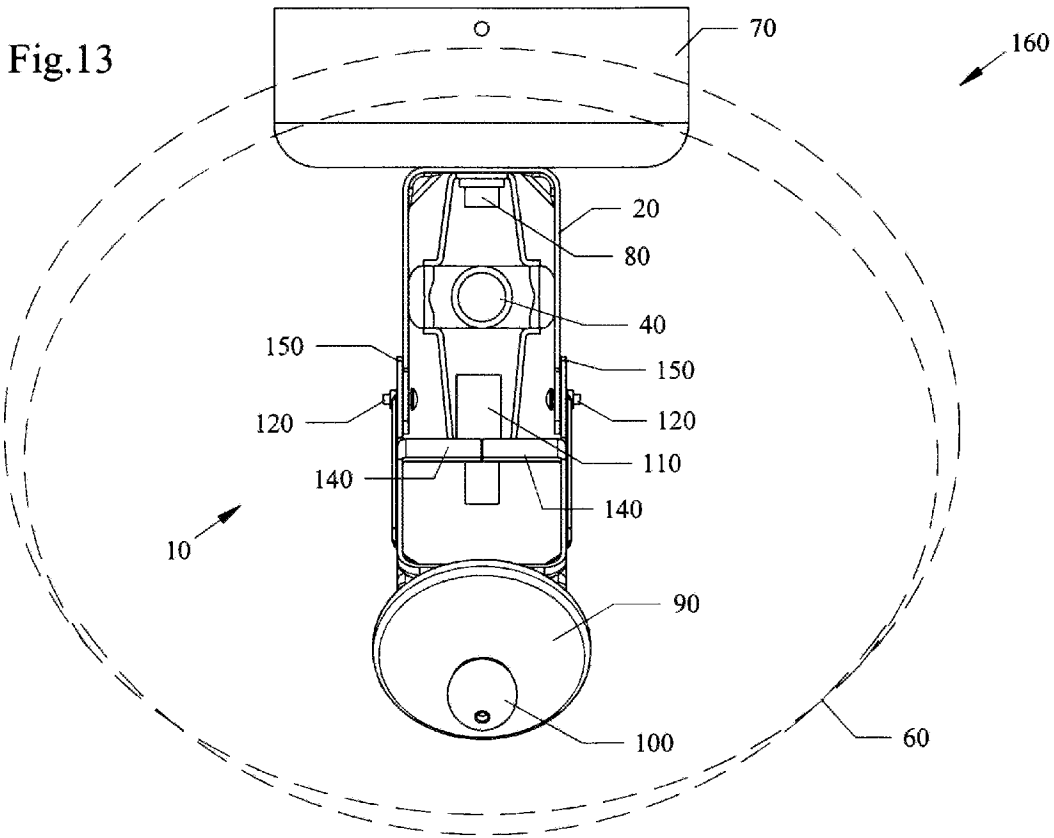
FIG. 13 is a back view of the light assembly of FIG. 10 with shade tilted toward the viewer.

FIG. 13 is a back view of the light assembly 160 of FIG. 10 with shade 60 tilted toward the viewer.

Figure 14:
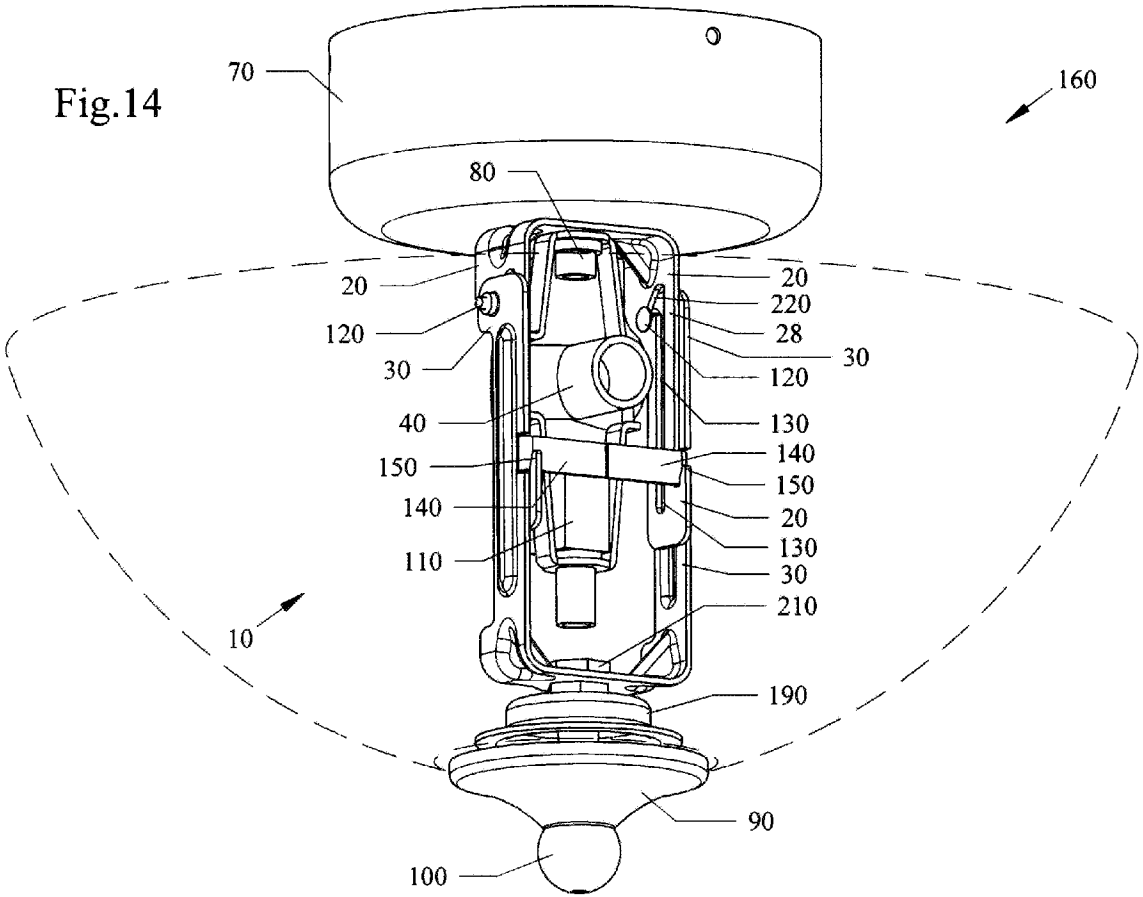
FIG. 14 is a perspective view of light assembly of 11 with brackets locked up without bulbs and with shade in dash line.

FIG. 14 is a perspective view of light assembly of 11 with brackets 20, 30 locked up without bulbs 50 and with shade 60 in dashed lines.

Figure 15:
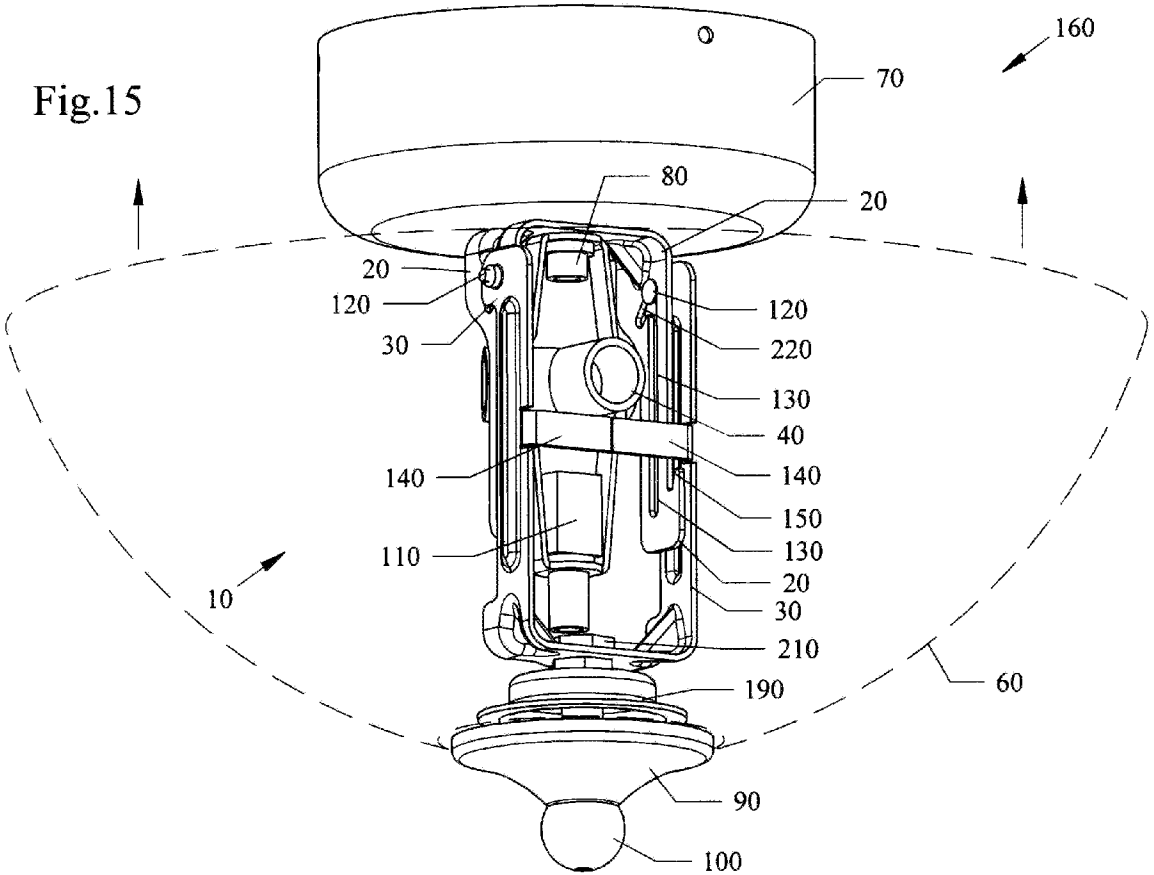
FIG. 15 is a perspective view of light assembly of FIG. 12 with bottom bracket pushed up.

FIG. 15 is a perspective view of light assembly 160 of FIG. 12 with bottom bracket 30 pushed up such that pivot screws (120) have been lifted out of resting slots (220) and lock bars (140) have been lifted out of lock hooks (150). This lines the pivot pins up with the upper bracket slots (130) so that the bottom bracket can be lowered.

Figure 16:
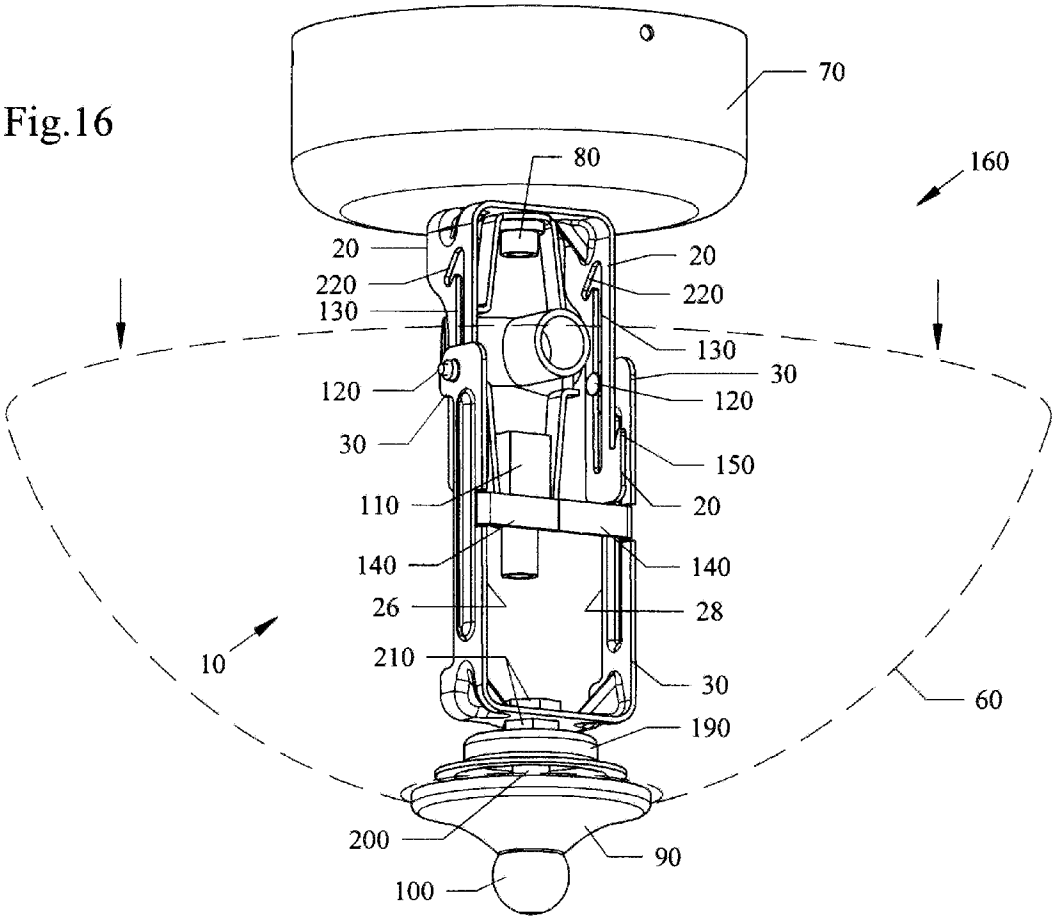
FIG. 16 is a perspective view of the light assembly or FIG. 15 showing the bottom bracket half way dropped.

FIG. 16 is a perspective view of the light assembly 160 of FIG. 15 showing the bottom bracket 30 half way dropped. The pivot screws 120 can be seen following the upper bracket slots.

Figure 17:
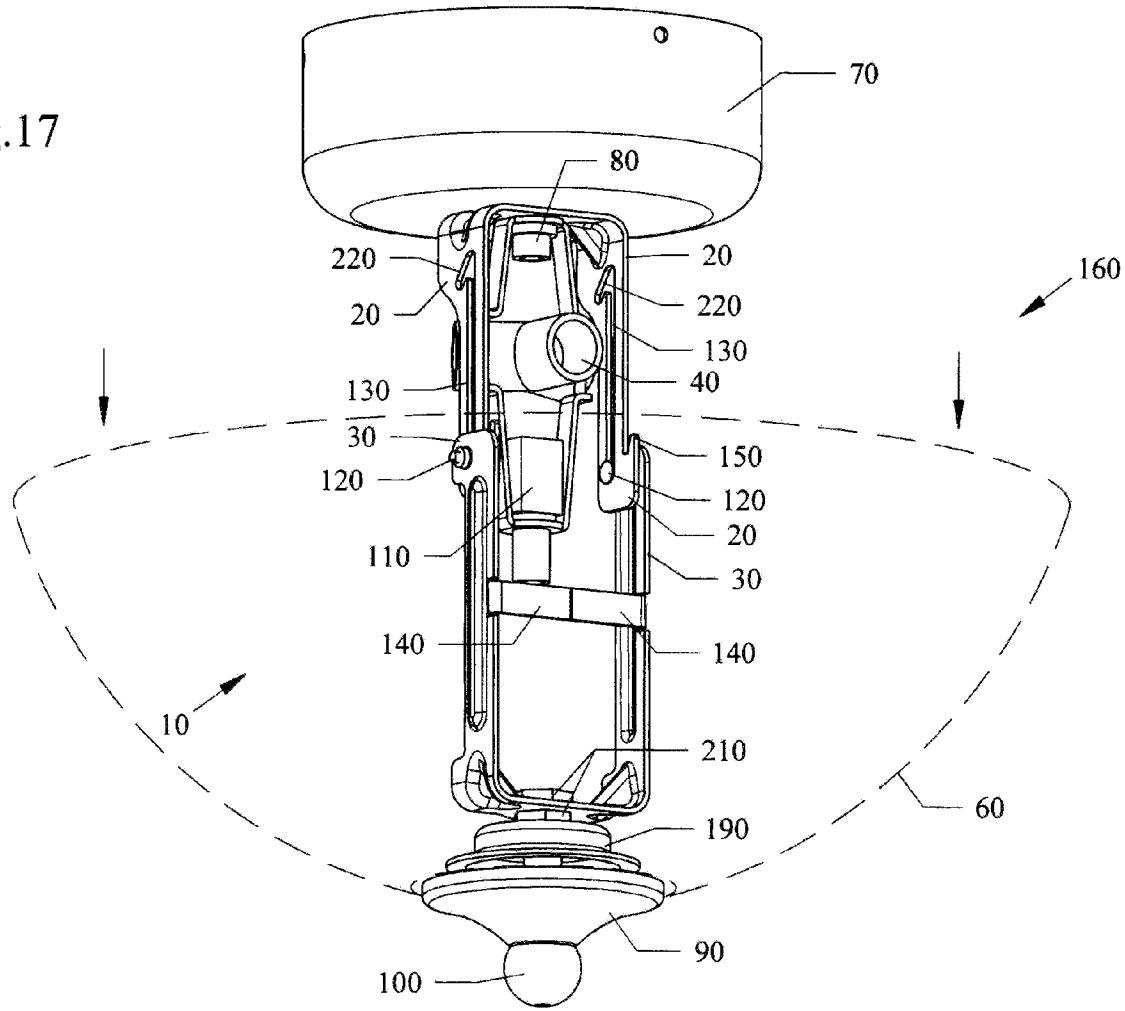
FIG. 17 is a perspective view of the light assembly of FIG. 16 showing the bottom bracket fully dropped.

FIG. 17 is a perspective view of the light assembly 160 of FIG. 16 showing the bottom bracket 30 fully dropped.

Figure 18:
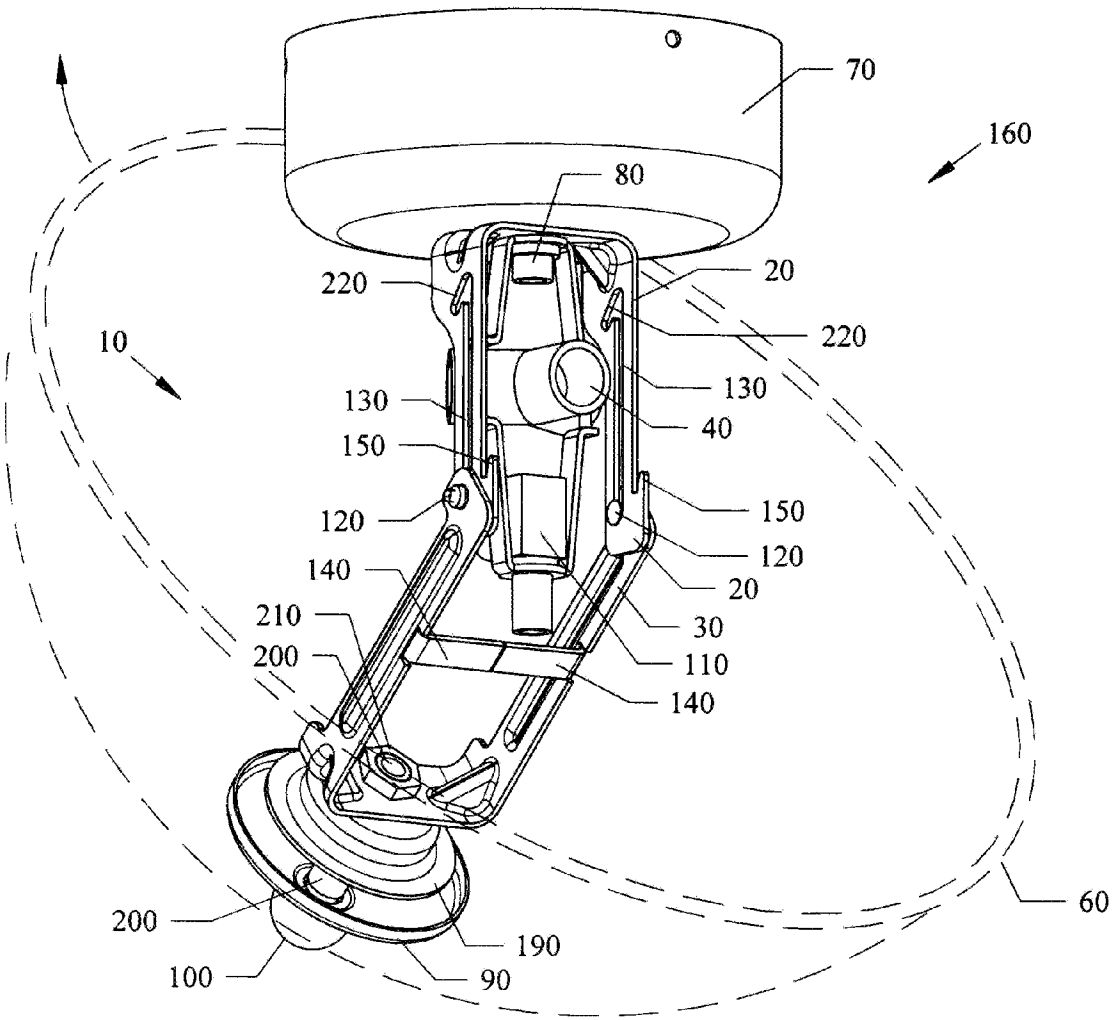
FIG. 18 is a perspective view of the light assembly 17 showing the bottom bracket fully dropped and tilted away from the viewer for bulb and cleaning access.

FIG. 18 is a perspective view of the light assembly 160 showing the bottom bracket 30 fully dropped and tilted away from the viewer for bulb 50 and cleaning access.

Figure 19:
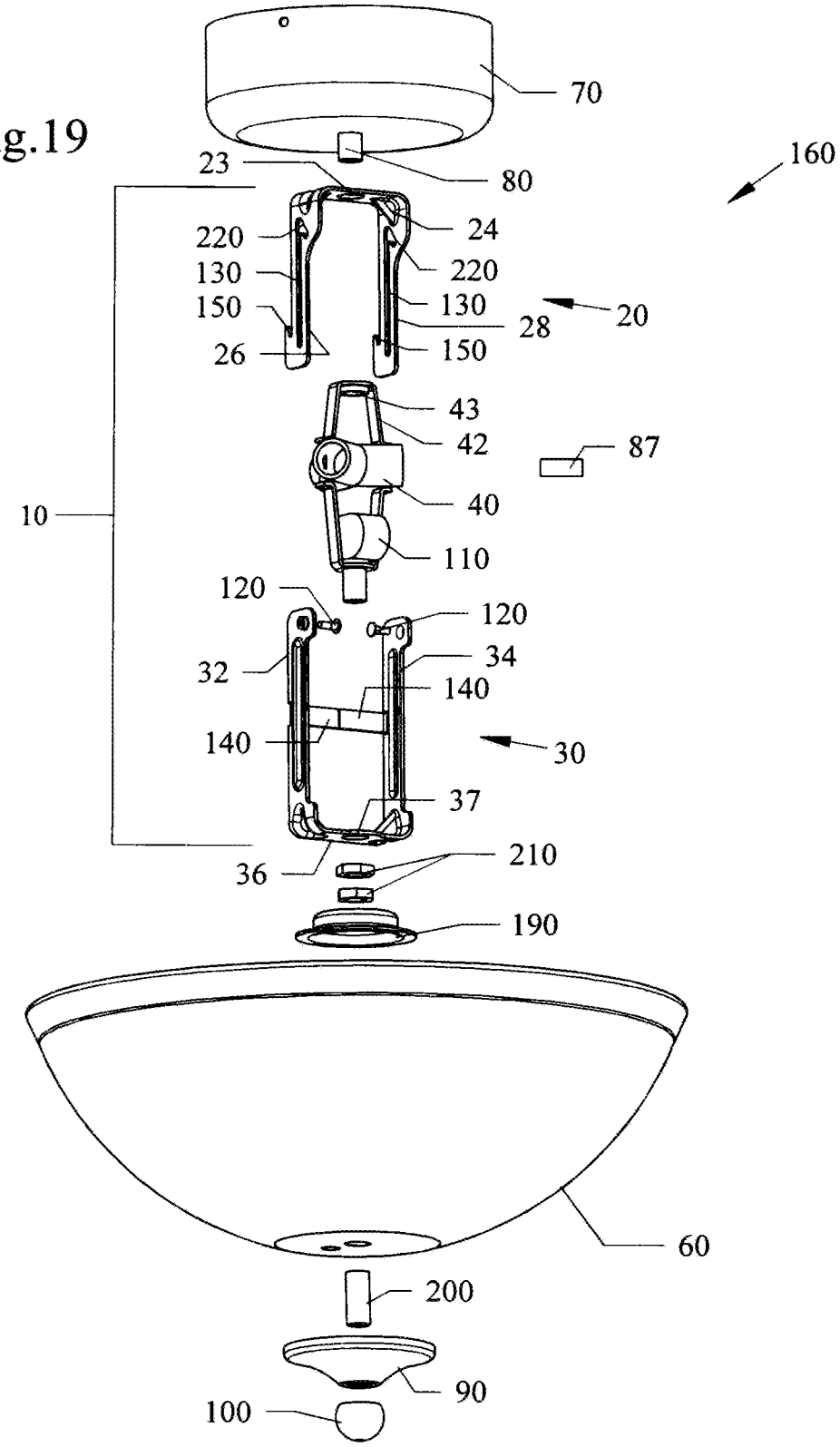
FIG. 19 is an exploded view of the ceiling mount light assembly of the preceding figures.

FIG. 19 is an exploded view of the ceiling mount light assembly 160 of the preceding figures.

Referring to FIGS. 1-4 and 19, the mount flange 70 can be attached to a ceiling or to a ceiling fan 180. Underneath the mount flange 70 can be a downwardly extending shaft 80 for passing through a through-hole 23 in a horizontal member 24 of the top bracket 20, and through a through-hole 43 in an upper horizontal member 42 of the light socket bracket 40. The lower surface of the shaft can have threaded exterior surface so that a nut 87 can hold the light socket bracket 20 and top bracket 20 mounted in place to the mount flange 70.

Bottom bracket pivot screws 120 can be screwed into openings in upper ends of vertical legs 32, 34 of bottom bracket 30, so that the tip ends of the screws 120 can loosely pass into the slots 130 on parallel legs 26, 28 of top bracket 20. When the tilt and clean fixture assembly 10 is in the up position bottom bracket lock bar 140 rests in the bracket lock hooks 150 securing the bottom bracket 30 in the up position.

Another mounting shaft 200 can have exterior threaded surfaces so that a top end of the shaft 200 passes through an opening in a shade mount flange 190 and through a through-hole 37 in horizontal member 36 of the bottom bracket 30. The finial mounting nuts 210 can be fastened to threaded exterior surface of the upper end of the shaft 200 and sandwich to both sides of the through-hole opening 37 in horizontal member 36 of bottom bracket 30. The bottom end of the shaft 200 passes through a through-hole opening in an upper final decorative portion, so that a lower finial portion, such as a decorative nut can be fastened thereon mounting the shade 60 to the bottom bracket 30.

The tilt and clean fixture assembly 10 can have a locked up position, a pushed up release position, a partially dropped position, and fully dropped extended position and a tilt position.

The locked up position of the tilt fixture assembly 10 is shown in FIGS. 5, 8, 11, and 14. Referring to FIGS. 5, 8, 11, 14 and 19, tilt fixture assembly 10, outer ends of bottom bracket pivot screw(s) 120 are in the resting slots 220 which is at the top of the vertical slots 130 of each of the vertical legs 26, 28 of the top bracket 20. The outer ends of the bottom bracket pivot screws 120 lock into these slots 220 when the bottom bracket 30 is in the up position. Here, the bottom bracket bar 140 rests in the upper bracket lock hooks 150 securing the bottom bracket 30 in the up position. In this locked up position, the exterior of the ceiling mount light assembly 160 and ceiling fan mount assembly 170 appear undistinguishable from traditional ceiling light fixtures and or from lights on ceiling fans.

The pushed up position is shown in FIG. 15. To release the tilt fixture assembly 10 from the locked up position, a user can push up on the bottom of the shade 60, preferably around the finial portions 90, 100, so that outer ends of pivot screws 120 move up in slots 220 to the top of vertical slots 130. FIG. 15 is a perspective view of light assembly 160 of FIG. 12 with bottom bracket 30 pushed up such that pivot screws 120 have been lifted out of resting slots 220 and lock bars 140 have been lifted out of lock hooks 150. This lines the pivot pins (ends of screws 120) up with the upper bracket slots 130 of the top bracket 20 so that the bottom bracket 30 can be lowered.

The partially half dropped position is shown in FIG. 16. Here, the outer ends of pivot screws 120 are able to ride in slots 130 of the vertical legs 26, 28 as the bottom bracket 30 slides downward relative to the top bracket 20 until the bottom bracket 30 reaches a fully dropped position. The fully dropped extended position is shown in FIGS. 6, 9, 12, 17.

Next, the user can push sideways against the bottom portions of shade 60, preferably about finial portions 90, 100 so that the shade 60 and bottom bracket 30 become tilted which allows access to the bulbs 50, bulb socket bracket 40 and the inside of shade 60. The tilted position is shown in FIGS. 7, 10, 13 and 18.

In the tilted position, the bulbs 50 can be changed out and/or the inside surface of the shade 60 can be cleaned.

After bulbs 50 are replaced or changed out and/or the inside surface of the shade 60 is cleaned, the above steps can be reversed until the bottom bracket 30 is back in a locked up position with top bracket 20.

Although the light sockets are shown attached to the top/upper bracket, the light socket(s) can be attached to the bottom/lower bracket.

While the brackets have been shown with generally rectangular shapes, the brackets can have other shapes, such as single elongated members.

While the upper/top bracket is shown with two vertical legs, this bracket can have a single elongated leg with a single elongated slot, or more than two elongated legs, and the like.

Although the upper bracket is shown with longitudinal slots and the bottom bracket with pins or screws, the bottom bracket can have the longitudinal slot(s) and the top bracket can have pin(s) or screws.

Although the shade is shown as a bowl, the shade can have other shapes, such as but not limited to globe shaped, rectangular shaped, and other geometrical shapes and the like.

Although the sliding brackets are shown having slots and pins, the brackets, the brackets can slide relative to one another by having telescoping parts where one part telescopes relative to another part.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An overhead light fixture comprising:

an upper bracket having a top end and a bottom end, the top end being attached to a ceiling mounted member, wherein the upper bracket includes:

an elongated leg member having an elongated slot; and a sliding member attached to the top end of the lower bracket so that the bottom bracket can slide up and down by the sliding member sliding within the elongated slot;

a bottom bracket having a top end and a bottom end, the top end of the lower bracket being slidable from a retracted lock position located above the bottom end of the upper bracket to a lowered position;

a pivotable portion for allowing the lower bracket to tilt relative to the upper bracket, when the bottom bracket is in the lowered position;

a removable light source attached to one of the upper bracket and the bottom bracket; and a light shade attached to the bottom end of the bottom bracket, wherein the light shade is tiltable when the bottom bracket is in the lowered position so that the light source and inside of the light shade are serviceable.

2. The light fixture of claim 1, wherein the ceiling mounted member includes:

a ceiling mounted member for attaching the light fixture to a ceiling.

3. The light fixture of claim 1, wherein the ceiling mounted member includes:

an attachment member for attaching the light fixture to a ceiling fan.

4. The light fixture of claim 1, wherein the light shade includes:

a bowl shape.

5. The light fixture of claim 1, wherein the sliding member is also the pivotable member.

6. The light fixture of claim 5, wherein the sliding member is a pin.

7. The light fixture of claim 6, wherein pin includes a screw.

8. The light fixture of claim 1, wherein the upper bracket further includes:

a second elongated leg member having a second elongated slot, the second elongated member being parallel to the first elongated leg member; and a second sliding member attached to the top end of the lower bracket so that the bottom bracket can slide up and down by the second sliding member sliding within the second elongated slot.

9. The light fixture of claim 1, further comprising:

a hook shaped slot at the top of the first elongated slot for locking the bottom bracket in the retracted lock position.

10. A method of servicing a light source and inside of a light shade on overhead light fixture without having to disassemble the light fixture, comprising the steps of:

attaching a top bracket to a ceiling mount member;

attaching a bottom bracket to a light shade;

slidably attaching the top bracket and the bottom bracket to each other;

sliding the bottom bracket from an up position to a down position;

tilting the light shade and the bottom bracket when the bottom bracket is in the down position; and servicing the light source and inside of the light shade when the light shade is tilted without disassembling the overhead light fixture.

11. The method of claim 10, further comprising the step of:

providing a ceiling mounted light as the overhead light fixture.

12. The method of claim 10, further comprising the step of:

attaching the ceiling mount member to a ceiling fan.

13. The method of claim 10, further comprising the steps of:

providing the top bracket with an elongated vertical leg member having a longitudinal slot;

attaching a pin to the bottom bracket; and sliding the bottom bracket up and down to the top bracket by the pin sliding in the longitudinal slot.

14. The method of claim 13, further comprising the steps of:

providing the top bracket with a second elongated vertical leg member having a second longitudinal slot, the second elongated vertical leg member being parallel to the first elongated vertical member;

attaching a second pin to the bottom bracket; and sliding the bottom bracket up and down to the top bracket by the second pin sliding in the second longitudinal slot.

15. The method of claim 13, further comprising the step of:

locking the bottom bracket in the up position.

16. The method of claim 15, wherein the locking step includes the step of:

providing the first longitudinal slot with a hook slot at an upper end; and positioning the first pin in the hook slot.

17. The method of claim 13, further comprising the step of:

pushing up on the bottom bracket to release the bottom bracket from the locked up position.

18. An overhead light fixture assembly for allowing light shades and lights sources to be serviceable without having to disassemble the fixture assembly, comprising:

a top rigid member attached to a ceiling mount member;

a bottom rigid member moveably attached to the top rigid member;

a light shade attached to the bottom rigid member; and a removable light source attached to the fixture assembly between the ceiling mount member and the light shade, wherein the bottom rigid member with light shade is moveable from an upper position to a lower position, and the light shade is tiltable in the lower position to allow the light source and interior of the light shade to be serviced.

19. The overhead light fixture assembly of claim 18, further comprising:

a lock position for locking the bottom rigid member to the top rigid member with the bottom rigid member is in the upper position.

* * * * *